US010280716B2

(12) United States Patent
Lugo et al.

(10) Patent No.: US 10,280,716 B2
(45) Date of Patent: May 7, 2019

(54) PROCESS AND SYSTEM FOR KILLING A WELL THROUGH THE USE OF RELIEF WELL INJECTION SPOOLS

(71) Applicants: TRENDSETTER ENGINEERING, INC., Houston, TX (US); ADD ENERGY GROUP AS, Stavanger (NO)

(72) Inventors: Mario R. Lugo, Houston, TX (US); Brett Morry, Houston, TX (US); Patrick Michael Cargol, Jr., Houston, TX (US); Ole Rygg, Stavanger (NO); Ray Tommy Oskarsen, Stavanger (NO)

(73) Assignees: TRENDSETTER ENGINEERING, INC., Houston, TX (US); ADD ENERGY GROUP AS, Stavanger (NO)

( * ) Notice: Subject to any disclaimer, the term of this patent is extended or adjusted under 35 U.S.C. 154(b) by 0 days.

(21) Appl. No.: 15/697,772

(22) Filed: Sep. 7, 2017

(65) Prior Publication Data

US 2018/0100379 A1 Apr. 12, 2018

Related U.S. Application Data

(63) Continuation-in-part of application No. 15/335,805, filed on Oct. 27, 2016, now Pat. No. 9,970,255.
(Continued)

(51) Int. Cl.
*E21B 33/076* (2006.01)
*E21B 33/064* (2006.01)
(Continued)

(52) U.S. Cl.
CPC ..... *E21B 41/0021* (2013.01); *E21B 33/038* (2013.01); *E21B 33/061* (2013.01);
(Continued)

(58) Field of Classification Search
None
See application file for complete search history.

(56) References Cited

U.S. PATENT DOCUMENTS

| | | | |
|---|---|---|---|
| 3,457,991 | A | 7/1969 | Sizer |
| 4,378,849 | A | 4/1983 | Wilkes |

(Continued)

FOREIGN PATENT DOCUMENTS

| | | | |
|---|---|---|---|
| EP | 0709545 | A2 | 1/2003 |
| WO | 1986002696 | A1 | 5/1986 |
| WO | 2012174194 | A2 | 12/2012 |

*Primary Examiner* — Matthew R Buck
*Assistant Examiner* — Douglas S Wood
(74) *Attorney, Agent, or Firm* — Egbert, McDaniel & Swartz, PLLC

(57) ABSTRACT

A process for killing a well includes drilling a first relief well and a second relief well toward the well, affixing a first relief well injection spool to the first relief well and affixing a second relief well injection spool to the second relief well, connecting a flowline to a flow channel of the first and second relief well injection spools, connecting a pipe to the first relief well injection spool so as to extend to a surface location, connecting a second pipe to the second relief well injection spool so as to extend to another surface location, and flowing a kill fluid through the second pipe such that the kill fluid flows through the flowline and into the flow channel of the first relief well injection spool so as to pass into the first relief well and into the well.

19 Claims, 9 Drawing Sheets

Related U.S. Application Data

(60) Provisional application No. 62/290,328, filed on Feb. 2, 2016.

(51) Int. Cl.

| | |
|---|---|
| ***E21B 41/00*** | (2006.01) |
| ***E21B 33/038*** | (2006.01) |
| ***E21B 33/06*** | (2006.01) |
| ***E21B 34/04*** | (2006.01) |
| ***E21B 43/30*** | (2006.01) |

(52) U.S. Cl.

CPC ..... *E21B 33/064* (2013.01); *E21B 33/076* (2013.01); *E21B 34/04* (2013.01); *E21B 43/305* (2013.01)

(56) References Cited

U.S. PATENT DOCUMENTS

| | | | | |
|---|---|---|---|---|
| 9,057,243 | B2 | 6/2015 | Hendell et al. | |
| 9,970,255 | B2 * | 5/2018 | Lugo | E21B 33/076 |
| 2012/0001100 | A1 | 1/2012 | Hubbell | |
| 2012/0305262 | A1 | 12/2012 | Ballard et al. | |
| 2013/0037272 | A1 * | 2/2013 | Dale | E21B 21/00 166/363 |

* cited by examiner

PROCESS AND SYSTEM FOR KILLING A WELL THROUGH THE USE OF RELIEF WELL INJECTION SPOOLS

CROSS-REFERENCE TO RELATED APPLICATIONS

The present application is a continuation-in-part of U.S. patent application Ser. No. 15/335,805, filed on Oct. 27, 2016, and entitled "Relief Well Injection Spool Apparatus and Method for Killing a Blowing Well", presently pending. U.S. patent application Ser. No. 15/335,805 claims priority from U.S. Provisional Patent Application Ser. No. 62/290,328, filed on Feb. 2, 2016, and entitled "Relief Well Injection Spool and Method of Using the Same to Kill a Well".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to well killing systems. More particularly, the present invention relates to processes and systems for injecting fluids into a relief well. Furthermore, the present invention relates to the use of relief well injection spools for introducing high volume and high-pressure fluids into a blowing well so as to kill the well.

2. Description of Related Art Including Information Disclosed Under 37 CFR 1.97 and 37 CFR 1.98

Several methods can be considered to control offshore blowouts, but they can all be classified as surface interventions or relief well methods, depending on the intervention approach. Surface intervention aims to control the blowout by direct access to the wellhead or fluid exit point of the wild well. Relief wells are used to gain control of blowouts in situations where direct surface intervention is impossible or impractical. Instead, relief well methods include killing the uncontrolled well downhole from a surface location at a safe distance away from the wild well. Blowout and kill simulation studies have shown that some wells could require more than one relief well for a dynamic kill operation.

In the aftermath of the Macondo blowout in the Gulf of Mexico in 2010, the development of surface intervention methods and subsea capping systems received a great deal of focus, but a operator will recognize that drilling a relief well followed by a dynamic kill operation will, in many cases, be the safest and most likely successful well intervention. Furthermore, in some blowout scenarios, it will be the only way to regain control. It is therefore important that the operator can demonstrate the feasibility of the relief well operation on a particular well and field.

Relief wells have been drilled regularly as a last-resort well-intervention method when other surface kill efforts have failed. In the early 20th century, relief wells were spudded in close proximity to a blowout and drilled vertically to the reservoir. Subsequently, the formation must be produced at a high rate to relieve pressure, which is where the "relief well" name originates. A milestone for directional relief wells occurred in 1933 when a blowout was killed for the first time by directly intersecting the flowing wellbore. The first application of magnetic ranging to achieve a downhole well intersection was performed in 1970. This ranging technique was further refined in the 1980s, which is now the basis of modern relief-well planning.

The dynamic kill technique for relief well kill was first defined by Mobil in 1981. In 1989, a blowout occurred in the Norwegian North NCS, where the dynamic kill operation was planned using the first dynamic kill simulator named OLGA-WELL-KILL. Since then, OLGA-WELL-KILL has evolved to become the industry's leading dynamic kill simulator and has been used successfully to plan an extensive number of blowout interventions.

The dynamic kill technique has been established as the preferred method for killing a blowout after intersecting with a relief well. The dynamic kill uses the increased hydrostatic head of a mixture of gas, oil, and mud in the blowing well together with the frictional pressure drop to increase the bottomhole pressure and consequently stop the flow from the reservoir. For very prolific/hard-to-kill blowouts, the pump rate necessary to be delivered at the intersection point can be beyond what can normally be pumped from a single relief well rig. This will trigger options to optimize the capacity of the relief well for the planning of two or more relief wells.

Multiple relief wells may be planned even when the kill measurements are within the limitations of a single drilling rig. In other words, a prolific blowout results in a massive discharge of oil so as to justify a secondary relief well as a back-up in case the primary well does not meet the target. This has been the case for many historical relief-well projects during the 2010 Macondo blowout, where two relief wells were drilled, but only one relief well actually intersected the target well. In fact, the only known incident were two relief wells simultaneously intersected a blowing wellbore was used for a dynamic kill is the 1995 Le-Isba onshore blowout in Syria. There is no actual experience of intersecting and coordinating a dynamic kill in offshore environment with multiple relief wells.

A kill operation with two relief wells is recognized as being a challenging operation. Two or more drilling rigs for the specific operation must be mobilized. Each of the drilling rigs drill a relief well from an approved surface location. Furthermore, both relief wells will have to simultaneously locate and intersect the blowing wellbore. The blowing well must be killed through a simultaneous coordinated kill operation. Complex operations are, in general, more time-consuming. As a result, this will increase the total volume of oil and gas released to the environment.

As a result of the limited experience with potential challenges, the NORSOK D-010 well integrity standard states that, for offshore wells, the well design should enable killing a blowout with one relief well. If two relief wells are required, the feasibility of such an operation must be documented. An offshore well design that requires more than two relief wells is not acceptable. Similarly, other governmental agencies will not grant approval for a permit to kill an exploration well if a worst-credible blowout may require two or more relief wells for the kill operation.

If the kill requirements are excessive and a drilling permit is not granted, the planned well design can, in some cases, be revised to lower the pumping requirements within the capacity of a single relief well. Some examples include setting the last casing string deeper to allow a deeper relief-well intersect, using a smaller diameter casing to increase friction during the dynamic kill, setting additional casing strings to isolate sands, or drilling a smaller hole size to lower the flow potential of potential flowing sands. In these cases, the planned well design is driven by dynamic kill requirements. An example of this is the Chevron Wheatstone project in which additional casing strings were set to allow a deeper relief well intersect and increase friction pressure in the blowout well during a dynamic kill.

Setting additional casing strings may come at a high cost since it requires great time, introduces additional risks, and could affect production rates. In other words, well is designed for smaller casing and, as result, smaller production tubing will flow at a lower rate per well than with larger tubing sizes. This may have a significant impact on the overall field development cost increase in the number of wells required to produce at a given rate. The cost increase of a standard well design can be in on the order of $50 million per well higher than for a big-bore well.

For a blowout where a relief well intervention is the only option and the kill requirements are expected to be very demanding, alternatives to multiple relief wells can include the risk of reducing the required pumping rate, performing a staged kill with high-density kill mud followed by a later static mud, or using special or reactive kill fluids. These techniques have been used on actual project with some success, but they may introduce additional risk and complexity. For blowout contingency planning, it is a proper business practice to be conservative and to plan for a standard dynamic kill with a uniform mud and with enough pump redundancy that the kill rate can be maintained if one pump fails. Thus, increasing the pumping capacity of a single relief well will often be the best alternative than relief to multiple relief wells.

When initiating a dynamic kill for a floating rig with the wellhead at the seabed, the relief well will be shut in at the blowout preventer using the pipe rams and kill fluid will be pumped down the choke-and-kill lines to the blowout preventer at the wellhead. Depending on the water depth and the choke-and-kill line size, the flow capacity and hence the pressure drop in the choke-and-kill lines could have a significant impact on the total flow rate that can be pumped down the relief well. For a deepwater relief well pumping operation, it is therefore critical to use a drilling rig with large diameter choke-and-kill lines.

To monitor the downhole pressure during the dynamic kill operation, the drill pipe must be in the wellbore. The size and length of the bottomhole assembly and the drill pipe could influence the total pressure drop in the wellbore. If required, the drill pipe and the bottom hole assembly can be swapped just prior to drilling the last few meters before reaching the intersection. To further enhance the flow capacity in the relief well, the casing design must be evaluated. A typical relief well design would include a 9⅝ inch casing set prior to intersection with a seven inch liner as a contingency to protect the open hole prior to the intersection point. If the 9⅝ inch casing is substituted with a liner, the flow capacity in the relief well may also increase significantly.

Pumping down both the annulus and the drill pipe simultaneously during the kill will increase the flow capacity and reduce the total pressure drop even further. This requires a pressure sensor in the bottom hole assembly to measure the dynamic pressure of well pumping to avoid fracturing operations during the kill and to know when to reduce the kill rate after the flowing bottom hole pressure exceeds the pore pressure. Performing the kill operation without downhole-pressure control is not recommended.

The methods mentioned above for increasing flow capacity may lower the required pumping pressure and hydraulic horsepower for the kill operation. However, if the required kill rate is still beyond the rig capacity, then additional pumping units must be added. Offshore drilling rigs suitable for relief well operations are required with a number of mud pumps and a cementing unit. However, if additional pump units are needed, then they must be lined up to the rigs' existing floor-space and high-pressure manifold system, which might require modification and redesign of the piping system. Additional pumps on deck also add weight and use up deck space. On many rigs, this can be a limiting factor.

To increase the pumping capacity of the relief well, a dedicated kill plant located on an independent dynamically-position support vessel will likely be preferred. The support vessel could be a drilling or workover rig, a stimulation vessel, or a floating barge with a high-pressure kill plant. To supply mud to the high-pressure pumping vessel, a large dynamically-positioned platform supply vessel with centrifugal pumps and low-pressure hoses positioned alongside the pumping vessel can be used.

To increase the pump capacity for the relief well, the dedicated kill plant on the support vessel will need to be linked together with the mud system of the relief well rig. There are three points-of-connection to be considered. These are the surface interface on the rig deck, the subsea interface with the rig equipment, and the subsea interface with a dedicated manifold located between the wellhead and the blowout preventer. The surface interface on the rig deck is a surface interface and the rig deck is a surface connection between two vessels. This is the industry operating practice to increase fluid storage and pumping capacity. Vessels are connected by high-pressure flex lines to a temporary high-pressure manifold constructed on the rig floor, which is then tied into the choke-and-kill lines. In addition to limitations of the size of the choke-and-kill lines, the flex lines need to be short enough to limit frictional losses, but long enough that wind, waves, and current would not cause the vessels to collide. The vessels would likely need to disconnect in seas of approximately four meters or greater.

In relation to the subsea interface with rig equipment, for a deep water relief well with a subsea wellhead, the kill fluid is pumped down the choke-and-kill lines to the blowout preventer and subsequently to the relief-well annulus between the wellbore in the drill pipe. The choke-and-kill lines are an integral part of the riser system, and they are connected to the blowout preventer/lower marine riser package mounted at the top of the wellhead. No additional inlets are available for pumping unless the system is redesigned and modified. One concept is to install a temporary manifold between the blowout preventer and the lower marine riser package. However, this would likely cause loss of the blowout preventer function. As such, it is considered impractical. A second concept is to cut the choke-and-kill lines on one of the riser elements and retrofit a Y-branch joint the can be used as a tie-in point for the flex lines from the support vessels. This would need to require the entire riser to be pulled to the surface (which would be time-consuming) or a second rig with a different riser system would need to be mobilized. Furthermore, with a Y-branch welded to the side of a riser element, the assembly might not fit through the rig rotary due to its external dimensions. Instead, the riser element would be deployed to the side and subsequently moved underneath the rig to be connected with the riser. A subsea interface with existing rig equipment would require modifications to suite-specific riser types and each individual blowout preventer/lower marine riser package interface. In the event of a blowout disaster, a solution that calls for major on-the-fly modifications to tailor-made equipment would add significant risks to the operation or would likely be disapproved by rig contractors, regulatory agents, and other stakeholders.

To address the problems associated with well blowouts, it is mandated that separate relief wells be drilled simultaneously in a direction toward the blowing well. The duplicate relief wells are intended to address those circumstances where the first relief well may not intersect the blowing well or would otherwise fail. The second relief well would then be available so as to progress in order to properly intersect with the blowing well. In each of these circumstances, both the first relief well and the second relief well are being drilled simultaneously by drilling vessels. If the first relief well should intersect the blowing well, then the second relief well will be stopped at a distance away from the blowing well. The kill fluids can then be injected into the first relief well in order to kill the well.

Unfortunately, the kill fluid that is introduced through the first relief well can only pass at a rate of approximately fifty barrels per minute. Twenty barrels per minute can be introduced through the drill pipe while thirty barrels per minute can be introduced through the choke-and-kill lines and into the annulus of the relief well. In a large variety of circumstances, the pressure that is created by the fifty barrels permitted that flows through the first relief well will be sufficient to kill the well. Unfortunately, many wells that are being drilled today are in high pressure zones. In these high-pressure zones, the fifty barrel per minute capacity of the relief well drilling system will be insufficient to kill the well. As such, a need has developed so as to be able to introduce high pressure and high volume fluids into the relief well.

When there is a blowout of a high-pressure well, it may be necessary for several relief wells to be drilled so as to intersect the blowing well. This will allow the kill fluid to be introduced from various locations. Ultimately, the amount of kill fluid that is introduced should have a weight that is greater than the bore pressure of the blowing well. As such, will be necessary to drill a large number of relief wells and install pumping equipment and pumping vessels so as to achieve the requisite fluid capacity in order to effectively kill the well. This is extremely costly, extremely time-consuming, and fraught with problems. As such, need has developed whereby the high volume and high pressure fluids can be properly introduced through a single relief well and into the blowing well.

In order to address these issues, the present Applicant has invented a relief well injection spool and method for killing a well as U.S. application Ser. No. 15/335,805. This relief well injection spool apparatus comprises a body having a pair of inlets opening to a bore on an interior of the body, a ram body cooperative with the bore of the body, an upper connector affixed to the body and adapted to connect the body to a lower end of the blowout preventer, and a wellhead connector affixed to a lower end of the body. Each of the pair of inlets has a valve cooperative therewith. The ram body is selectively movable so as to open and close the bore. The upper connector opens to the bore of the body. The wellhead connector is adapted to connect to a relief well. The wellhead connector opens to the bore of the body.

This application further describes a well killing system for killing a primary well in which the primary well has a well bore extending to a producing reservoir. The well killing system includes a relief well bore extending through a seabed so as to open to the primary wellbore, a relief well injection spool affixed to the relief wellhead, a blowout preventer affixed to an end of the relief well injection spool opposite the relief wellhead, and a kill line connected to one of the pair of inlets of the relief well injection spool. The kill line passes kill fluid into the relief well injection spool. This application further describes a method for killing a well that includes the steps of forming a primary wellbore to a producing reservoir, forming a relief well bore extending so as to open to the primary wellbore, affixing the relief well injection spool to a wellhead of the relief well bore in which the relief well injection spool has a pair of valved inlets extending to the way bore of the spool, injecting a kill fluid into the pair of inlets, and flowing the kill fluid through the bore of the relief well injection spool, through the relief bore, and into the primary wellbore.

This prior application by the present Applicant is quite effective in addressing those issues of medium pressure wells. However, when higher pressure wells must be addressed, it is necessary to substantially increase the volume of kill fluid into the relief wellbore. As such, a need has developed so as to be able to properly introduce high-pressure high volume fluids into the relief well injection spool and thereby into the relief well so as to kill the well.

In the past, various patents have issued relating to techniques for controlling downhole pressures and for containing fluids. For example, U.S. Pat. No. 9,057,243, issued on Jun. 16, 2015, to Hendell et al., discloses an enhanced hydrocarbon well blowout protection system. The protection at a hydrocarbon well is enhanced by placing a blowout preventer over a wellhead. An adapter is connected to the blowout preventer. The adapter includes a valve that, when turned off, prevents non-production flow from the blowout preventer to a riser pipe.

U.S. Pat. No. 4,378,849, issued on Apr. 5, 1983, to J. A. Wilkes, teaches a blowout preventer having an mechanically-operated relief valve. The blowout preventer has a mechanical linkage to a valve connected to a pressure relief line in the casing beneath the blowout preventer whereby the valve on the pressure relief line is opened when the blowout preventer is actuated. The blowout preventer includes an upright tubular body having an annular packing therein which can be constructed about a drill pipe or other pipe in the well, a head connected to the top of the upright tubular body for containing the annular packing in the body, a piston slidably received in the body and adapted to selectively constrict the packing about the well pipe, a casing pipe connected to the lower end of the body for containing the well pipe, a pressure relief line connected to the casing having a valve therein, and a rod connected to the piston and the valve to open the valve when the piston slides within the tubular body to constrict the packing about the well pipe.

U.S. Pat. No. 3,457,991, issued on Jul. 29, 1969 to P. S. Sizer, discloses a well control flow assembly which includes a plurality of blowout preventers and an automatic subsurface safety valve positioned in the blowout preventers. The valve is biased to a closed position and is moved to an open position by pressure fluid which is controlled by means positioned at the surface of the well. One object of this invention is to provide a new and improved flow control assembly which is installable in the well during the drilling of the well. It is held in place in the well installation by blowout preventers used in the drilling of the well. It is provided with a valve located below the blowout preventers which may be controlled from the surface for controlling flow from the well.

U.S. Patent Application Publication No. 2012/0305262, published on Dec. 6, 2012, to Ballard et al., shows a subsea pressure relief device. This device serves to relieve pressure and a subsea component. The device includes a housing included including an inner cavity, and open end in fluid communication with the inner cavity, and a through bore extending from the inner cavity to an outer surface of the housing. The device has a connector coupled to the open end. The connector is configured to releasably engage a mating connector coupled to the subsea component. The device further includes a burst disc assembly mounted to the housing within the through bore. The burst disc assembly is configured to rupture at a predetermined differential pressure between the inner cavity in the environment outside the housing.

U.S. Patent Application Publication No. 2012/0001100, published on Jan. 5, 2012 to P. J. Hubbell, discloses a blowout preventer-backup safety system. The system serves to address the problem of having a failed blowout preventer. This provides an independent backup safety system when encountering an oil/gas well "kick" or blowout and is not reliable in any of the complex, multiple components of the blowout preventer. The system includes a double manifold, double bypass device which is a supplemental connection between the wellhead in the inlet of the blowout preventer that allows for relief for both temporary and/or extended time. Until repairs, replacements, or capping procedures are complete.

European Patent No. 0709545, published the Jan. 15, 2003 to S. Gleditsch, teaches a deep water slim hole drilling system. The system relates to an arrangement used for drilling oil or gas wells, especially deep water wells. This system provides instructions for how to utilize the riser pipe as part of the high-pressure system together with the drilling pipe. The arrangement comprises a surface blowout preventer which is connected to a high-pressure riser pipe which input, in turn, is connected to a well blowout preventer. A circulation/kill line communicates between the blowout preventers.

International Publication No. WO 2012174194 in the name of the present applicant discloses a diverter system for a subsea well which has a blowout preventer and a diverter affixed to an outlet of the blowout preventer. The blowout preventer has an interior passageway with an inlet at the bottom thereof and an outlet at the top thereof. The diverter has a flow passageway extending therethrough and in communication with the interior passageway of the blowout preventer. The diverter has a valve therein for changing a flow rate of a fluid flowing through the flow passageway. The diverter has at least one channel opening in valved relation to the flow passageway so as to allow fluid from the flow passageway to pass outwardly of the diverter. At least one flow line is in valved communication with the flow passageway so as to allow fluids or materials to be introduced into the flow passageway.

International Publication No. WO1986002696, published on May 9, 1986, to J. R. Roche, shows a marine riser well control method and apparatus. This method and apparatus serves to maintain safe pressure in the annulus of a deep-water marine riser by preventing the displacement of drilling mud with formation gas. By providing an improved flow diverting control device having an annular sealing device in the riser string below the riser telescopic joint, liquid well fluids under limited pressure can be maintained in the riser despite the impetus of formation gas below the mud column to displace the liquid. The provision of an annular shut-off below the telescopic joint eliminates the necessity to seal well fluid pressure at the telescopic joint packer during kick control circulating operations. The flow diverting control device includes an outlet which opens on the opening of the annular sealing device and which provides a flow path beneath the annular sealing device to a choke lined to facilitate bringing the well under control by circulating kill mud. If the blowout preventer stack is on the bottom, circulation can be directed down a riser kill line in introduced into the annulus above a closed ram. If the blowout preventer is open or if the stack is not on the bottom, circulation is directed down the drill pipe, up the riser annulus and through a choke manifold. By maintaining a mud column in the riser annulus, the hazard of collapsing the pipe by an external hydrostatic head near the lower end of a deepwater marine riser is avoided.

It is an object of the present invention to provide a process and system for killing a well which allows high volume and high-pressure fluids to be introduced into a blowing well.

It is another object of the present invention to provide a process and system for killing a well that eliminates the necessity of installing pumps and storage tanks on the relief well drilling rig.

It is another object of the present invention to provide a process and system for killing a well which can effectively kill high pressure wells.

It is still another object of the present invention to provide a process and system for killing a well which makes use of the existing infrastructure of the second relief well.

It is still further object of the present invention to provide a process and system for killing a well which can be mobilized in a minimal amount of time.

It is still a further object of the present invention to provide a process and system for killing a well which allows a potential worst-case blowout scenario to be killed with a single relief well.

It is still a further object of the present invention to provide a process and system for killing a well which minimizes the time, cost and manpower required for the killing of a high-pressure well.

These and other objects and advantages of the present invention will become apparent from a reading of the attached specification and appended claims.

BRIEF SUMMARY OF THE INVENTION

The present invention is a process for killing a blowing well. This process include the steps of: (1) drilling a first relief well toward the well; (2) drilling a second relief well toward the well; (3) affixing a first relief well injection spool to a wellhead of the first relief well; (4) affixing a second relief well injection spool to a wellhead of the second relief well; (5) connecting a first flowline to a flow channel of the first relief well injection spool to a flow channel of the second relief well injection spool; (6) connecting a first pipe to the first relief well injection spool so as to extend to a surface location; (7) connecting a second pipe to the second relief well injection spool so as to extend to another surface location; and (8) flowing a kill fluid through the second pipe so that the kill fluid flows through the flowline and into the flow channel of the first relief well injection spool so as to pass through the first relief well and into the well. The first relief well injection spool has a main bore and at least one flow channel in communication with the main bore. The second relief well injection spool has at least one flow channel communicating with a main bore thereof.

In the process of the present invention, the step of drilling the first well relief well includes drilling the first relief well in a direction toward the well, stopping the drilling prior to intersecting the well, and plugging the first relief well with a plug. In this circumstance, the first pipe is a drill pipe. The process further comprises removing or penetrating the plug with the drill pipe and drilling so as to intercept the well prior to the step of flowing the well fluid.

The step of drilling the second relief well includes drilling the second relief well so as to terminate the second relief well a distance away from the well. The steps of drilling the first relief well and the second relief well occur during The same period of time.

The flow channel of the first relief well injection spool includes a first flow channel and a second flow channel. Similarly, the flow channel of the second relief well injection spool includes a first channel and a second channel. The step of connecting includes connecting the first flow line to the first flow channel of the first relief well injection spool and to the first flow channel of the second relief well injection spool. The second flow line is connected to the second flow channel of the second relief well injection spool and to the second flow channel of the first relief well injection spool.

The step of connecting the second pipe to the second relief well injection spool includes extending a riser from the second relief well injection spool. The riser has a casing extending through an interior thereof. The casing communicates with the main bore of the second relief well injection spool. A first blowout preventer is affixed onto the first relief well injection spool. The first pipe extends through the first blowout preventer. Choke-and-kill lines extend from the surface location to the first blowout preventer. The choke-and-kill lines communicate with an annulus of the first relief well.

In the present invention, the first pipe is a drill pipe. The kill fluid flows through an interior of the drill pipe and into the well. The kill fluid also flows through the choke-and-kill lines into the annulus of the well. The kill fluid flows through the casing of the second pipe and into the main bore of the second relief well injection spool. The kill fluid then flows from the main bore of the second relief well injection spool through the flow channel and through the first flowline to the first relief well injection spool. The kill fluid will then flow from the first relief well injection spool into the well. The flow of kill fluid is stopped when the weight of the kill fluid exceeds a bore pressure of the well.

The present invention is also a system for killing a well. The system includes a first relief well having a wellhead, a second relief well having a wellhead, a first relief well injection spool affixed to the wellhead of the first relief well, a second relief well injection spool affixed to the wellhead of the second relief well, a flowline connected to a flow channel of the first relief well injection spool and to the flow channel of the second relief well injection spool, a first pipe is received by the bore of the first relief well injection spool and extends to a surface location, a second pipe communicates with the main bore of the second relief well injection spool and extends to another surface location, a first pumping system is cooperative with the first pipe so as to pump the kill fluid through the first pipe and into the first relief well, and a second pumping system is cooperative at the second pipe so as to pump the kill fluid through the second pipe, through the flow channel of the second relief well injection spool, through the flowline, through the first relief well injection spool and into the first relief well.

In the system of the present invention, the first pipe is a drill pipe and the second pipe is a casing. The flow channel of the first relief well injection spool includes a first flow channel and a second flow channel. Similarly, the flow channel of the second relief well injection spool includes a first flow channel and a second flow channel. The flowline is connected is connected the first flow channel of the first relief well injection spool and to the first flow channel of the second relief well injection spool. Another flowline is connected to the second flow channel of the first relief well injection spool and to the second flow channel of the second relief well injection spool. The system of the present invention has a first blowout preventer affixed to the first relief well injection spool and a second blowout preventer affixed to the second relief well injection spool. The first pipe extends through the first blowout preventer. The second pipe extends to the second blowout preventer. A choke-and-kill line is connected to the first blowout preventer so as to pass the kill fluid from the surface location into an annulus of the first relief well. The first pumping system pumps up to thirty barrels per minute of the kill fluid through the choke-and-kill line. The first pumping system also pumps up to twenty barrels per minute of the kill fluid through the drill pipe. The second pumping system pumps up to 180 barrels per minute of kill fluid through the casing. The first relief well is in spaced relation to the second relief well. Each of the first and second relief wells extend in a direction toward the well.

The first relief well is in spaced relation to the second relief well. Each of the first and second relief wells extends in a direction toward the well. The first relief well communicates with the well. The second relief well is blocked from communication with the well. The second pumping system includes a first kill vessel connected to the second pipe and a second kill vessel connected to the second pipe. The first and second kill vessels selectively or jointly pump the kill fluid under pressure into the second pipe.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
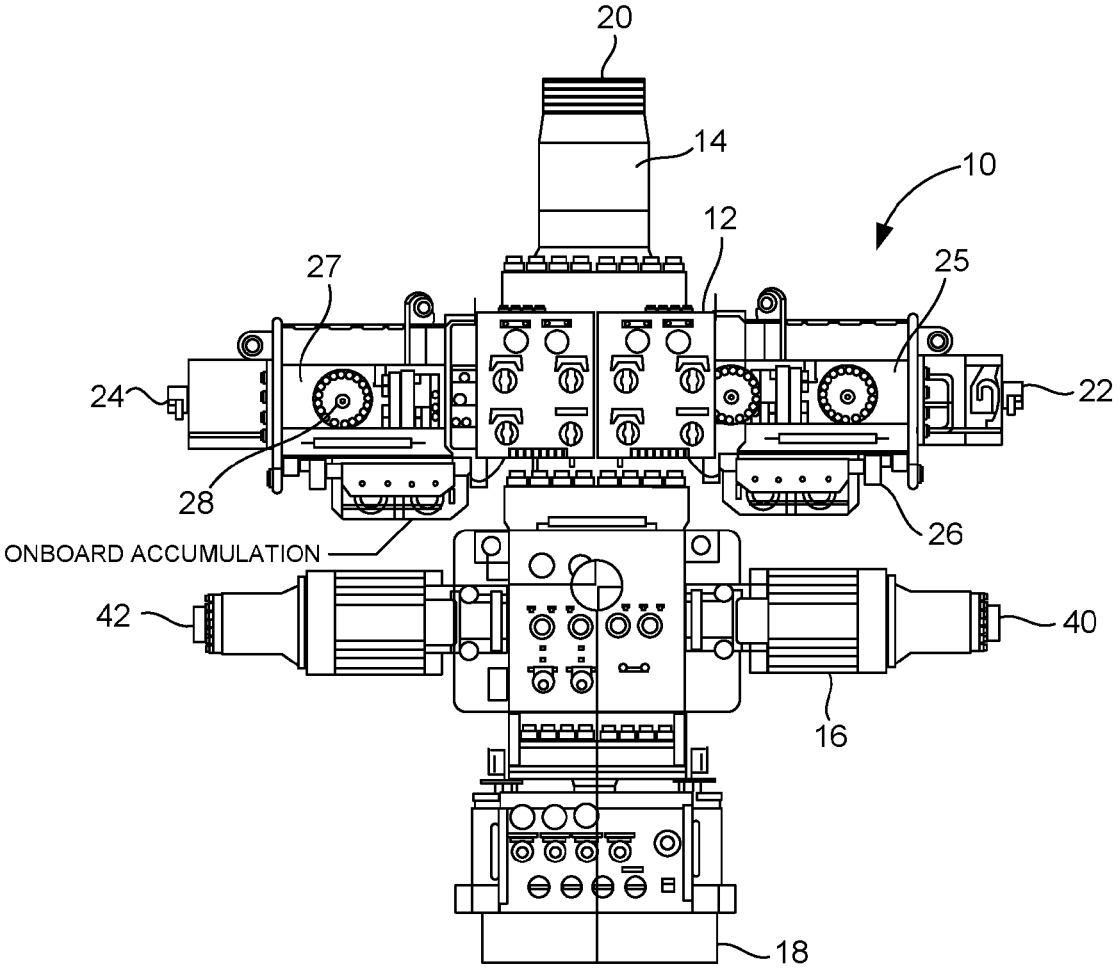
FIG. 1 is a side elevational view of the first relief well injection spool of the present invention.

Referring to FIG. 1, there is shown the first relief well injection spool in accordance with the teachings of the present invention. The first relief well injection spool 10 includes a diverter inlet spool 12, an upper mandrel 14, a ram body 16, and a wellhead connector 18. The upper mandrel 14 is affixed to the upper side of the diverter inlet spool 12. The ram body 16 is affixed to a lower end of the diverter inlet spool 12 opposite the upper mandrel 14. The wellhead connector 18 is affixed to a lower end of the ram body 16 opposite the diverter inlet spool 12. The wellhead connector 18 is configured so as to connect to the relief well wellhead.

The diverter inlet spool 12 is configured so as to allow kill fluids to be introduced into the internal bore 20 extending through the diverter inlet spool 12, through the ram body 16 and through the wellhead connector 18. In particular, the diverter inlet spool 12 includes a first inlet 22 and a second inlet 24. These inlets 22 and 24 will extend through the body of the diverter inlet spool 12 so as to have an inner end opening to the bore 20. The inlets 22 and 24 will communicate with respective first and second flow channels 25 and 27 to the bore 20. A pair of valves 26 and 28 are configured so as to cooperate with the flow channels 25 and 27. Valves 26 and 28 are isolation valves that are independently actuatable. Suitable buckets will be associated with each of these valves. The buckets will be configured so as to allow an actuator associated with an ROV to be used to open and close the valves, as required. When the valves 26 and 28 are open, the kill fluid can flow through the flow channels 25 and 27. When the valves 26 and 28 are closed, the kill fluid cannot flow through the flow channels 25 and 27. Inlets 22 and 24 are diametrically opposed on the diverter inlet spool. Suitable flowlines can be connected thereto so as to deliver the kill fluid from the second relief well injection spool (to be described hereinafter).

The mandrel 14 is affixed to the upper side of the diverter inlet spool 12. The upper mandrel 18 is configured so as to connect to the bottom of a blowout preventer. The bore 26 will have the same diameter as that of the blowout preventer. The ram body 16 is affixed to the lower end of the diverter inlet spool 12. The ram body 16 include selectively actuatable rams 40 and 42. These rams 40 and 42, when actuated, can extend across the bore 20 so as to seal the bore. Each of the rams 40 and 42 can have an ROV backup function.

When the kill fluid enters each of the inlets 22 and 24 and flows through the respective flow channels 25 and 27 toward the bore 20, the blowout preventer (mounted upon the mandrel 14) will block upward fluid flow. As such, the kill fluids will flow downwardly in the bore 20 within the ram body 16. Fluids will then flow downwardly through the bore, through the wellhead connector 18 and outwardly into the relief wellbore. The ram body 16 is illustrated as having rams 40 and 42 cooperative therewith. The rams 40 and 42 can operate so as to close the bore 20, if desired.

Figure 2:
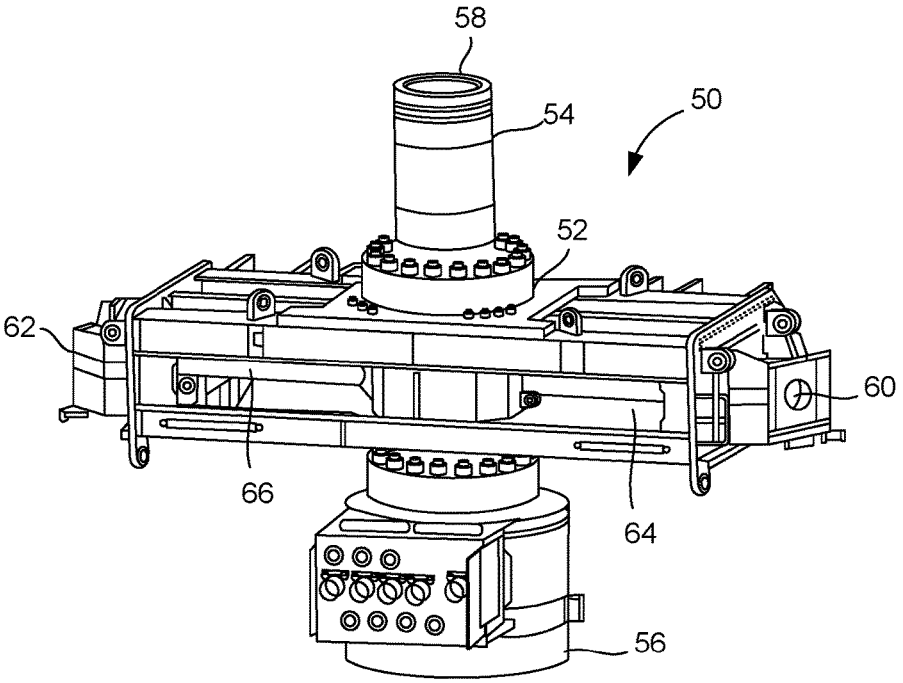
FIG. 2 is a perspective view of the second relief well injection spool of the present invention.

FIG. 2 shows the second relief well injection spool 50 of the present invention. The second relief well injection spool 50 is very similar in structure to that of the first relief well injection spool 10. However, the second relief well injection spool 20 omits the ram body 16 and various other control functions that would be found on the first relief well injection spool. Since the second relief well injection spool 50 is not associated with drilling functions, this spool can be greatly simplified. The second relief well injection spool 50 includes a diverter body 52, a mandrel 54 extending upwardly from the diverter body 52, and a wellhead connector 56 at a lower end thereof. A main bore 58 will extend through the upper mandrel 54, through the diverter body 52 and through the wellhead connector 56. The diverter body 52 has outlets 60 and 62 at opposite ends thereof. Outlets 60 and 62 will communicate with respective flow channels 64 and 66 on the interior of the diverter body 52. Flow channels 64 and 66 will communicate with the main bore 58 of the second relief well injection spool 50. As such, when kill fluids are introduced through the main bore 58, the diverter body 52 can transmit such fluids outwardly therefrom and outwardly through outlets 60 and 62. The wellhead connector 56 is adapted to be affixed to a wellhead of the other relief well.

Figure 3:
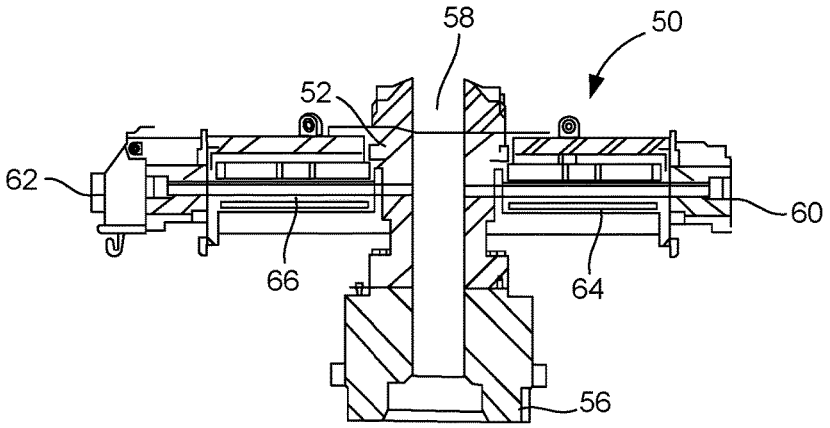
FIG. 3 is a cross-sectional view of the second relief well injection spool of the present invention.

FIG. 3 shows a cross-sectional view of the second relief well injection spool 50. As can be seen, the main bore 58 extends vertically through the interior of the diverter body 52. The outlets 60 and 62 communicate with the flow channels 64 and 66 respectively. The main bore 58 will extend downwardly so as to open at the wellhead connector 56.

Figure 4:
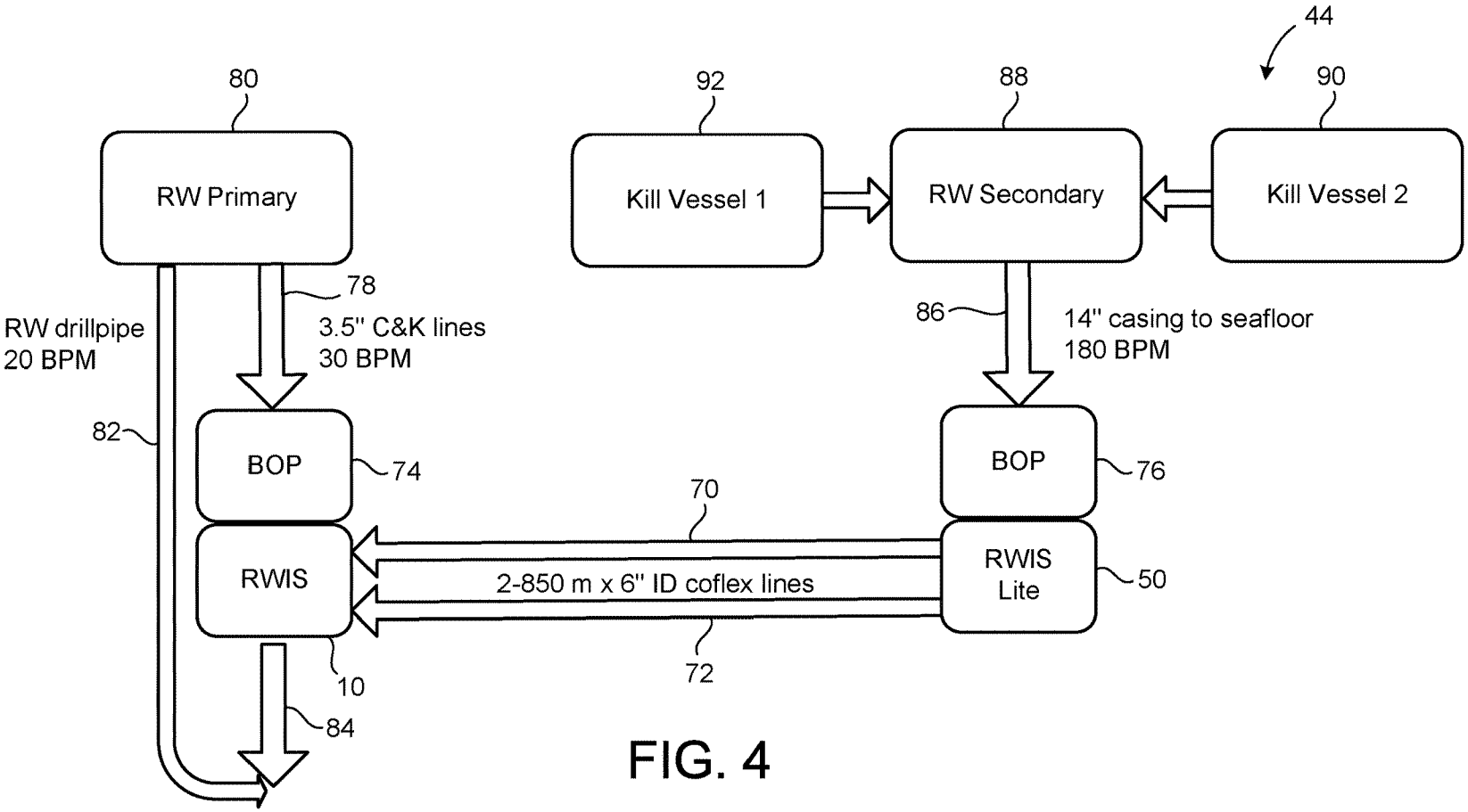
FIG. 4 is a block diagram showing the process of the present invention for the killing of a well.

FIG. 4 shows generally, in block diagram form, the operation of the present invention. In FIG. 4, the first relief well injection spool 10 is affixed to a first relief well. The second relief well injection spool 50 will be affixed to the wellhead of the second relief well. A pair of flowlines 70 and 72 extend between the relief well injection spools 10 and 50. These flowlines 70 and 72 are 2-850 m×6" ID coflex lines. A blowout preventer 74 is affixed to the top of the first relief well injection spool 10. A second blowout preventer 76 is affixed to the top of the second relief well injection spool 50. A first pipe 78 is illustrated as extending from the first relief well injection spool 10 and the first blowout preventer 74 to a drilling vessel 80. The pipe 78 can include 3.5 inch choke-and-kill lines. Pipe 78 can further include the drill pipe 82 that extends from the drilling vessel 80 downwardly so as to intersect with the first relief well 84. A second pipe 86 is illustrated as extending from a surface vessel 88 downwardly toward the second blow out preventer 76 and the second relief well injection spool 50. Kill vessels 90 and 92 are connected to the surface vessel 88 so as to pump the kill fluid into the second pipe 86, through the blowout preventer 76, through the second relief well injection spool 50, through the flowlines 70 and 72 and into the first relief well injection spool 10. From there, these high-pressure fluids will flow downwardly into the first relief well 84. The second pipe 86 is a fourteen inch casing that extends to the seafloor. This casing is capable of allowing 180 barrels per matter of kill fluid to be delivered from the kill vessels 90 and 92. The kill vessels 90 and 92 can be operated selectively, individually or jointly so as to pump the kill fluid.

In FIG. 4, the choke-and-kill lines of first pipe 78 allow for pumping thirty barrels per minute into the annulus of the relief well 84. The drill pipe 82 can allow for twenty barrels per minute of kill fluid to be pumped into the relief well 84. Ultimately, the system 94 of the present invention can allow up to 230 barrels per minute of kill fluid to be introduced to the blowing well. This greatly exceeds the capacity of previous structures and systems.

Figure 5:
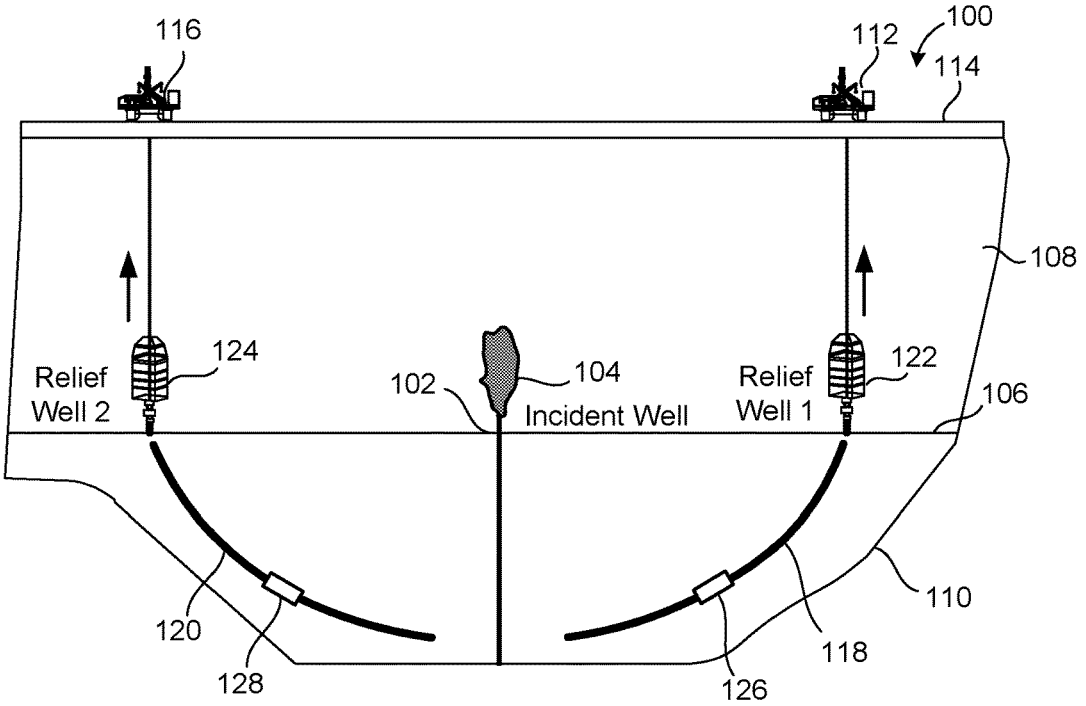
FIG. 5 is an illustration of an initial step in the process of killing a well of the present invention.

FIG. 5 shows an initial step in the process 100 of the present invention. In FIG. 5, it can be seen that there is an incident well 102 that is releasing hydrocarbons 104 in a location adjacent the seabed 106 in the body of water 108. The incident well 102 will extend for a distance in the earth 110 to the reservoir.

FIG. 5 shows the initial steps in addressing this emergency situation of the blowing well. In particular, a first drilling vessel 112 is moved to a location on the surface 114 of the body of water 108. A second drilling vessel 116 is moved to another location on the surface 114 of the body of water 108. Each of the drilling vessels 112 and 116 will drill downwardly so as to form a first relief well 118 and a second relief well 120. Each of the relief wells 118 and 120 are directed toward the incident well 102.

Under current regulations, in order to address the situation of a blowing well, regulatory requirements require that a pair of relief wells be drilled simultaneously. In the event that the first relief well does not intercept the incident well 102, the second relief well is in a "standby" mode so as to be utilized so as to intercept the well 102. In the initial step of the process 100 of the present invention, the first relief well 108 is stopped in a location adjacent to the intercept point of the incident well 102. Similarly, the second relief well 120 is also stopped at a location away from the incident well 102. A first blowout preventer 122 is mounted on the wellhead of the first relief well 118. A second blowout preventer 124 is mounted on the wellhead of the second relief well 120. As can be seen in FIG. 5, a plug 126 has been introduced into the first relief well 118 so as to block the potential passage of fluids through the first relief well 118. Similarly, a plug 128 can be positioned in the second relief well 120.

Figure 6:
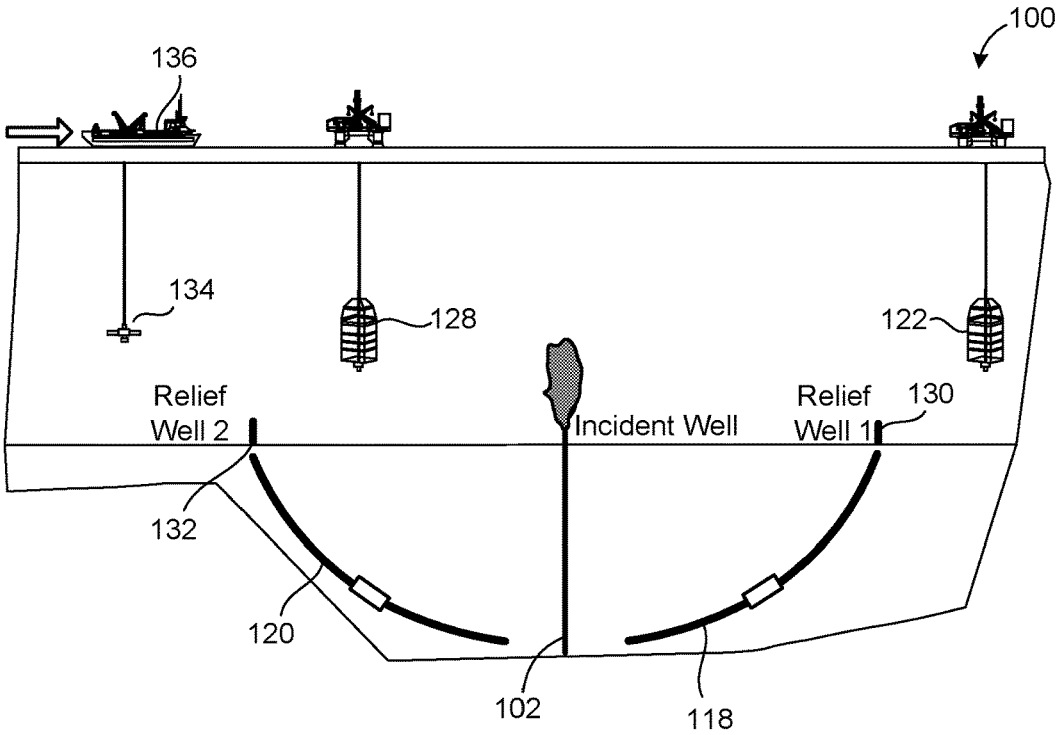
FIG. 6 is an illustration of the next step in the process of killing the well of the present invention in which the relief wellheads are exposed.

In FIG. 6, it has been determined by measurements that the first relief well 118 will actually intercept the incident well 102. As such, the necessity for the completion of the second relief well 120 is minimized or eliminated. The blowout preventer 122 is shown as removed from the wellhead 130 of the first relief well 118. Similarly, the blowout preventer 124 is removed from the wellhead 132 of the second relief well 120. The second relief well injection spool 134 is illustrated as being transported in position by a field development vessel 136. As such, the second relief well injection spool 134 is be delivered so as to be in proximity to the wellhead 132 of the second relief well 120.

Figure 7:
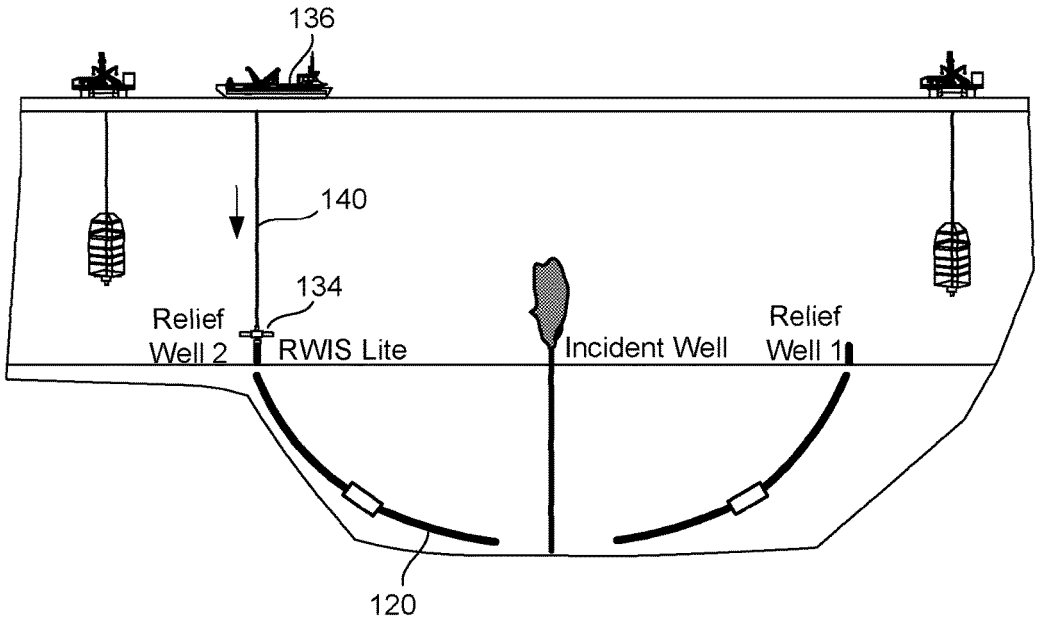
FIG. 7 is a further step in the process of killing a well of the present invention in which one of the relief well injection spools is installed on a wellhead of the a relief well.

FIG. 7 shows a further step in the process 100 of the present invention. In particular, it can be seen that the second relief well injection spool 134 has been installed on the wellhead 132 of the second relief well 120. The second pipe 140 will extend from the field development vessel 136 to the second relief well injection spool 134.

Figure 8:
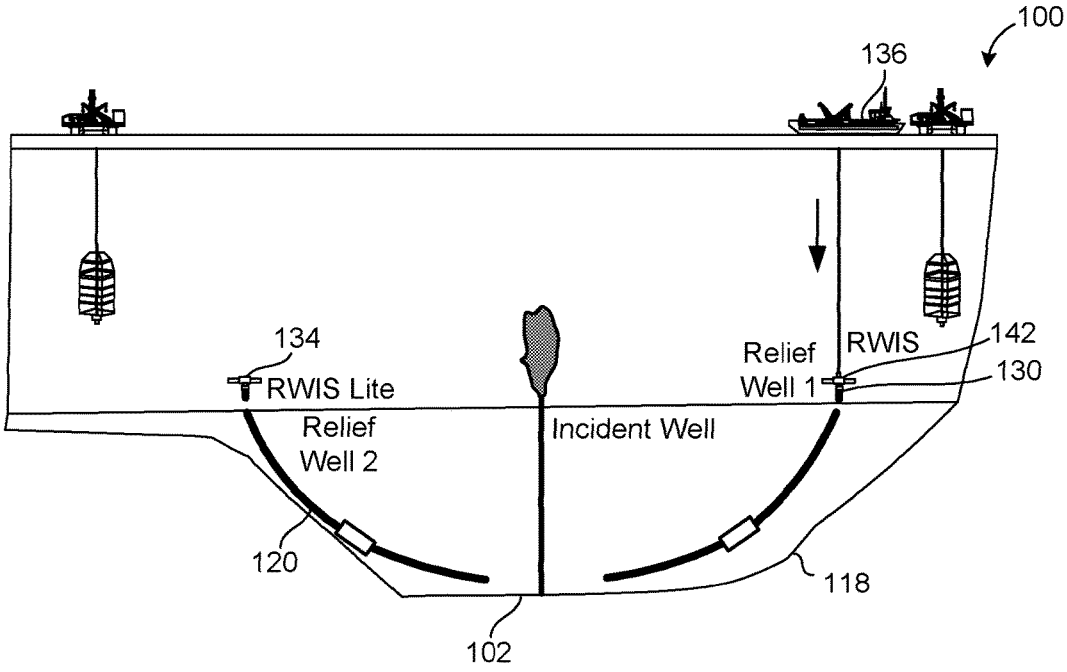
FIG. 8 is an illustration of a further step in the process of killing a well at of the present invention in which another relief well injection spool is positioned on the wellhead of the other relief well.

FIG. 8 shows a still further step in the process 100 for the killing of the incident well 102. In FIG. 8, the second relief well injection spool 134 is installed on the wellhead 132 of the second relief well 120. The field development vessel 136 is moved to a position over the wellhead 130 of the first relief well 118. As such, it will lower the first relief well injection spool 142 onto the wellhead 130. The first relief well injection spool 142 can be installed by conventional means onto the wellhead 132.

Figure 9:
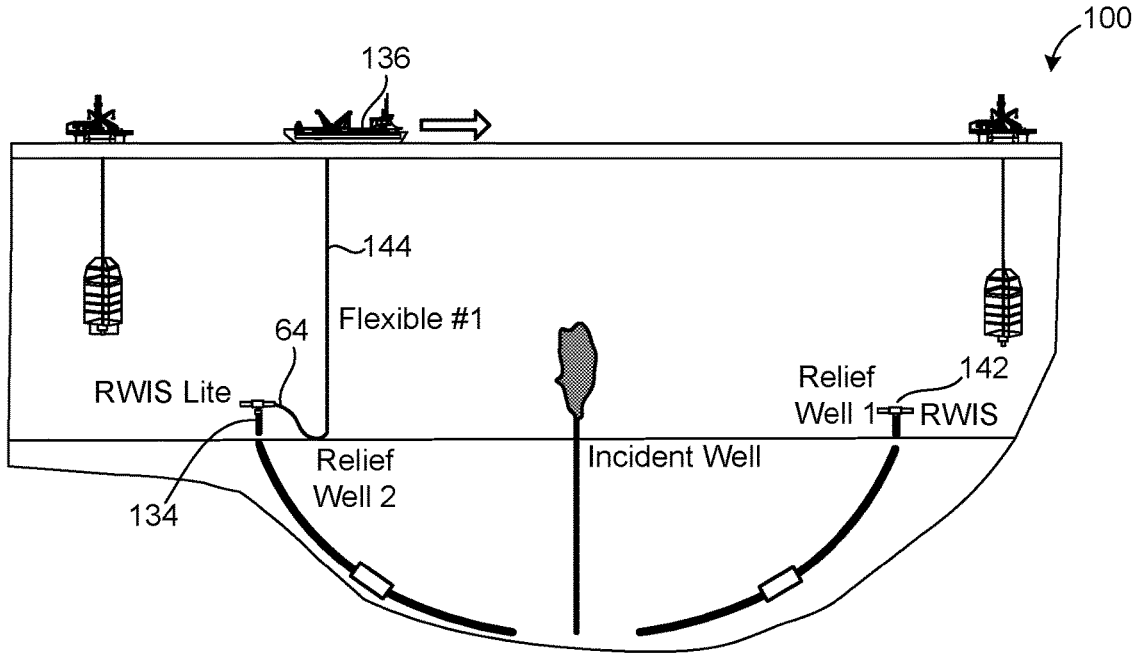
FIG. 9 is an illustration of a further step in the process of killing the well of the present invention showing the connection of a flowline to one of the relief well injection spools.

FIG. 9 shows a further step of the process 100 of the present invention in which the field development vessel 136 deploys a flow line 144 to the second relief well injection spool 134. The flow line 144 is connected to the flow channel 64 of the second relief well injection spool 134. This connection can be established by several techniques, including ROV manipulation. The flow line 144 should have a sufficient length so as to extend all the way to the first relief well injection spool 142.

Figure 10:
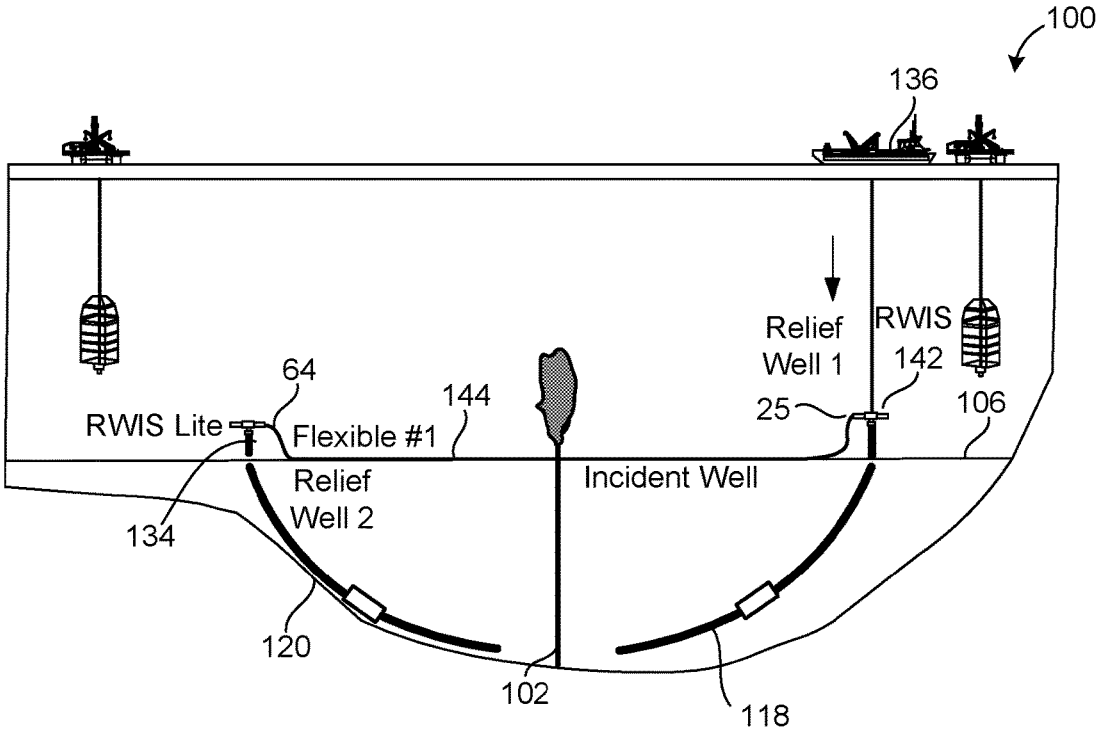
FIG. 10 is an illustration of a further step in the process of killing a well of the present invention in which the flowline is shown as connected to the other relief well injection spool.

FIG. 10 shows still further step in the process 100 for the killing of the well. In FIG. 10, the flowline 144 has been installed on to the flow channel 64 of the second relief well injection spool 134 and is connected to a flow channel 25 of the first relief well injection spool 142. The flowline 144 will extend continuously along the seabed 106. During this process, the first relief well 118 and the second relief well 120 remain obstructed, blocked, or unconnected to the incident well 102.

Figure 11:
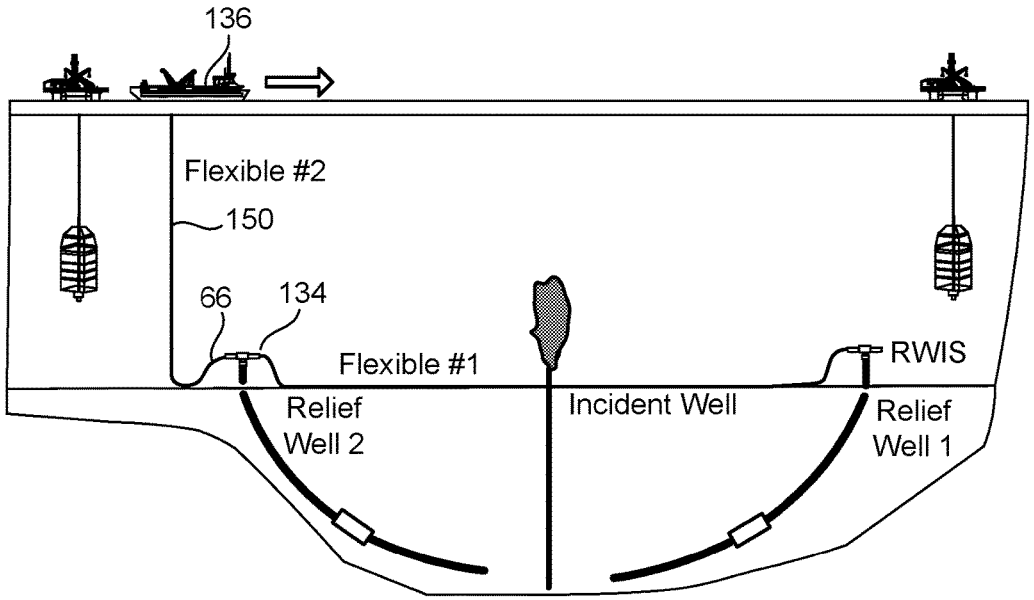
FIG. 11 is an illustration of a further step in the process of killing a well of the present invention in which another flowline is connected to one of the relief well injection spools.

FIG. 11 shows that the field development vessel 136 has delivered a second flowline 150 to the second relief well injection spool 134. The second flowline 150 will be connected to the outlet 62 of the flow channel 66 of the second relief well injection spool 134.

Figure 12:
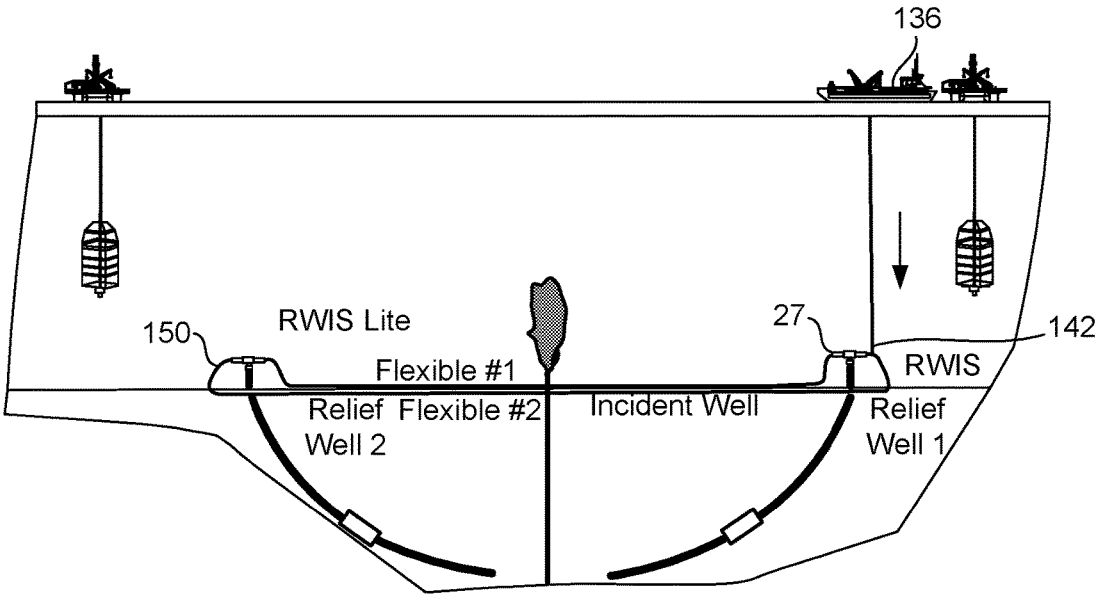
FIG. 12 is an illustration of a further step in the process of killing a well of the present invention in which the second flow line is connected to the other relief well injection spool.

FIG. 12 shows that the second flowline 150 has been moved by the field development vessel 136 so as to have a location adjacent to the first relief well injection spool 142. In particular, the second flowline 150 will have an end that is connected to the inlet 24 of the flow channel 27 of the first relief well injection spool 142. These connections can be easily carried out by conventional means, such as an ROV.

Figure 13:
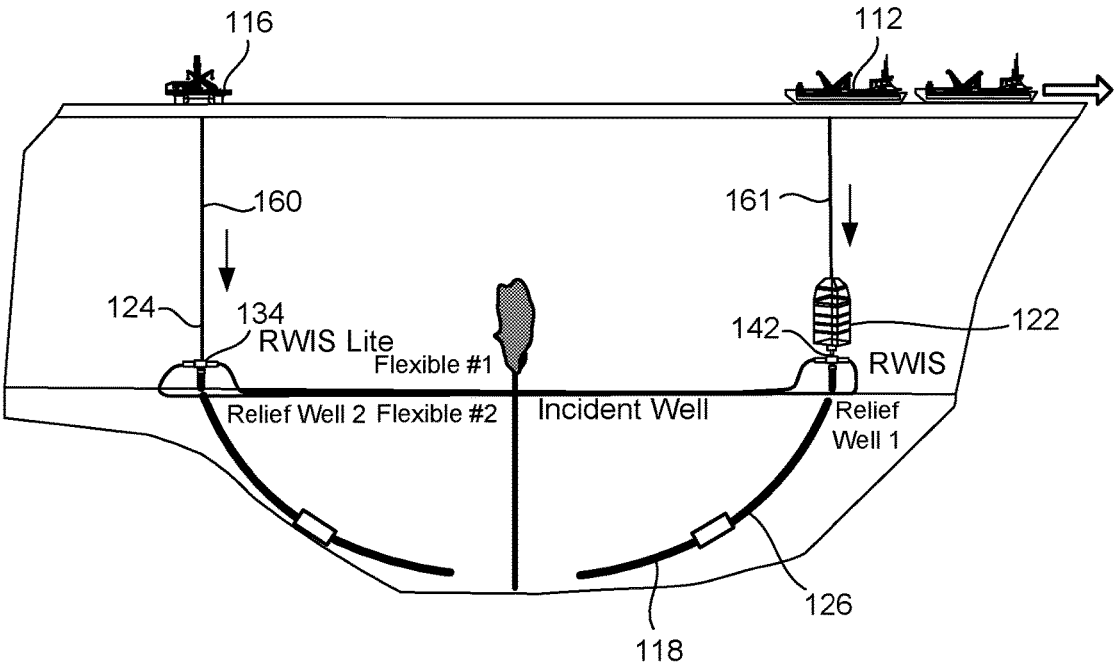
FIG. 13 is an illustration of a further step in the process of killing a well the present invention in which the blowout preventers are reinstalled onto the relief well injection spools.

FIG. 13 shows that the blowout preventer 122 has been installed onto the top of the first relief well injection spool 142. A first pipe 160 will extend from the blowout preventer 122 to the drilling vessel 112. The second blowout preventer 124 is now installed on to the mandrel of the second relief well injection spool 134. A second pipe 162 will extend from surface vessel 116 and be connected to the bore of the blowout preventer 122 into the main bore of the second relief well injection spool 134.

As shown in FIG. 13, the first pipe 116 can include the drill pipe and the choke-and-kill lines, as described hereinbefore. Ultimately, the pipe 160, along with the blowout preventer 122 should have the capacity to allow proper drilling operations to be carried out by the drilling vessel 112. At this time, it is necessary to remove the plug 126 from the first relief well 118. This can be carried out by drilling through the plug 126 or by retrieving the plug 126.

Figure 14:
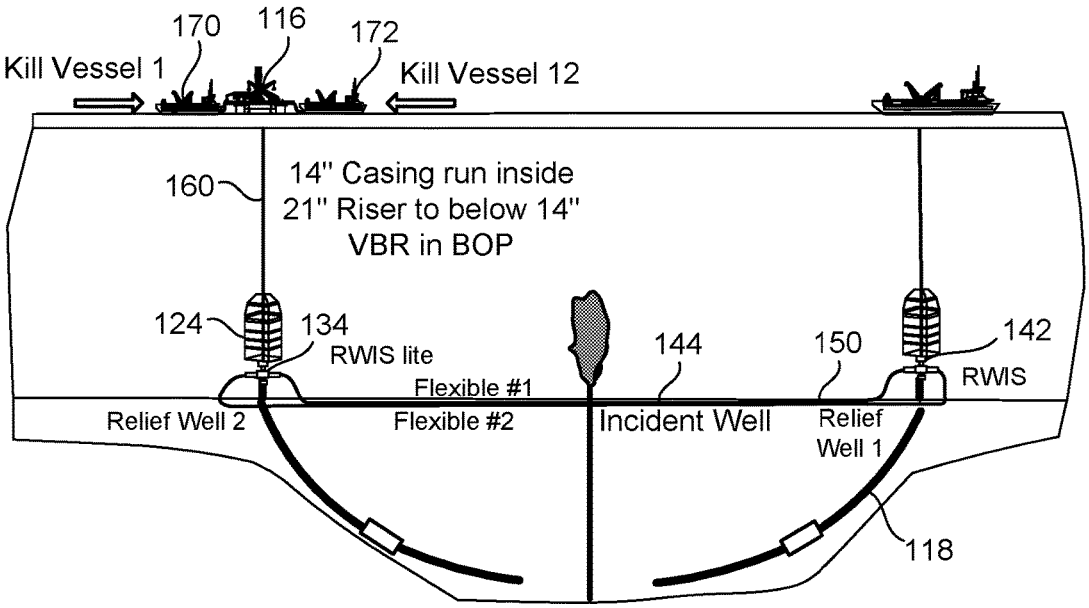
FIG. 14 is an illustration of a further step in the process of the killing a well of the present invention in which the riser and casing are extended to the blowout preventer of the relief well injection spool.

FIG. 14 illustrates that the surface vessel 116 has a first kill vessel 170 and a second kill vessel 172 adjacent thereto. Kill vessels 170 and 172 will have a sufficient supply of kill fluid thereon and suitable pumping equipment so as to be able to deliver the kill fluid through the second pipe 160. The second pipe 160 is made up of a twenty-one inch riser and a fourteen inch casing within the riser. The use of the fourteen inch casing allows an extremely high volume of high pressure and high volume kill fluid to be delivered to the second relief well injection spool 134 and through the respective flowlines 144 and 150 to the first relief well injection spool 142. As such, these high volume and high pressure fluids are available for delivery into the first relief well 118.

Figure 15:
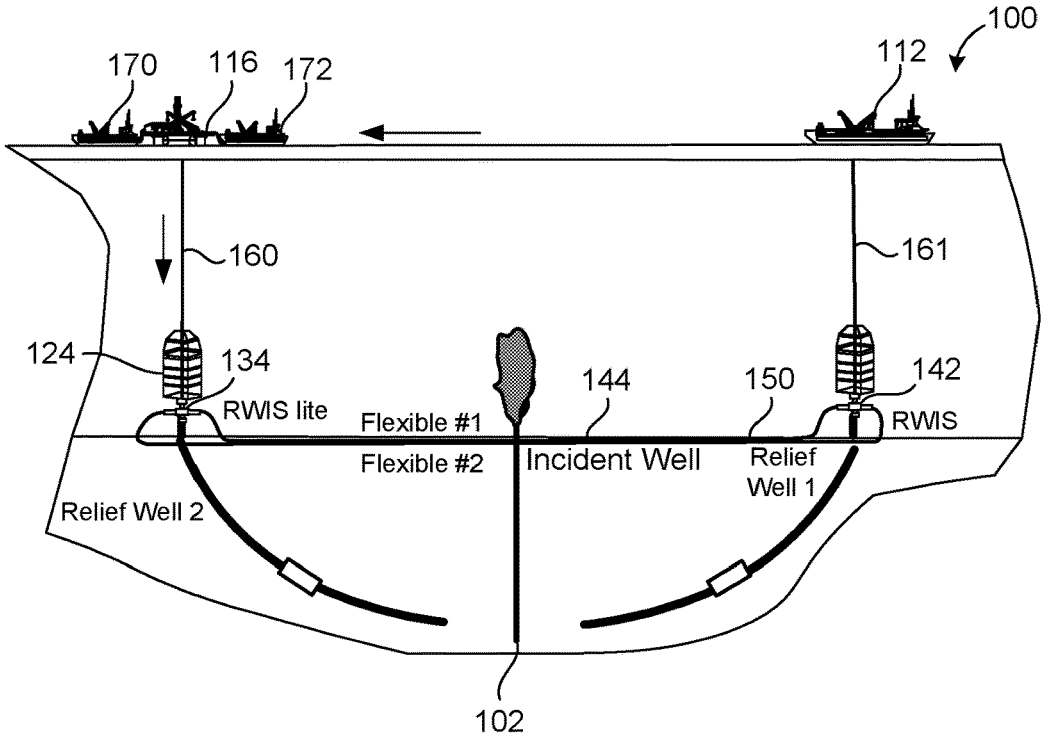
FIG. 15 is an illustration of a further step in the process of killing a well of the present invention showing the introduction of kill fluid into the system.

FIG. 15 shows a further step in the process 100 of the present invention in which the first kill vessel 170 and the second kill vessel 172 pump across the surface vessel 116 down the fourteen inch casing of the second pipe 160 to the second relief well injection spool 134. This fluid will pass through the flowlines 144 and 150 to the first relief well injection spool 142. Meanwhile, the drilling vessel 112 will pump the kill fluid down the 3.5" choke-and-kill lines in the first pipe 100. As such, the flow from the kill vessels 170 and 172 and from the drilling vessel 112 will be co-mingled within the relief well injection spool 142 where it can be then injected into the reservoir of the incident well 102. Once everything is hooked up and tested, the final steps in the dynamic kill process of the present invention can be carried out.

Figure 16:
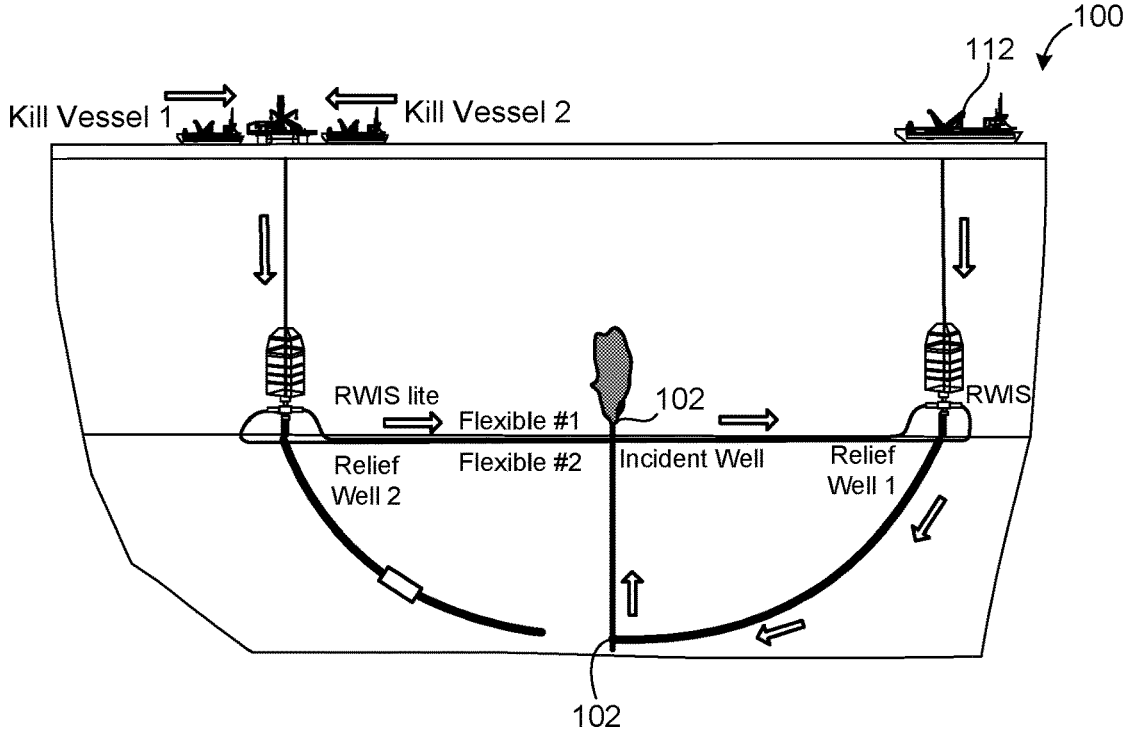
FIG. 16 is an illustration of still a further step in the process of the present invention showing the flow of kill fluid through the various flow channels, flowlines and relief well injection spools into the incident well.

FIG. 16 shows the killing of the blowing well 104 at the incident well 102. As can be seen, the drilling vessel 112 will remove the plug 126 so that the first relief well 118 is drilled so as to intersect the incident well 102. The fluid will flow in the direction of the arrows in FIG. 16. The killing fluid from each of the surface locations is injected into the incident well 100 and to just above the bottom shoe of the incident well. The well is dynamically killed once the weight of the kill fluid exceeds the bore pressure and the flow from the incident well stops. In FIG. 16, it can be seen that this flow has stopped.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A process for killing a well, the process comprising:

drilling a first relief well toward the well;

drilling a second relief well toward the well such that the second relief well is in spaced relation to the first relief well;

affixing a first relief well injection spool to a wellhead of the first relief well, said first relief well injection spool having a main bore and at least one flow channel in communication with said main bore;

affixing a second relief well injection spool to a wellhead of the second relief well, said second relief well injection spool having at least one flow channel in communication with a main bore thereof;

connecting a first flowline to the flow channel of said first relief well injection spool and to the flow channel of said second relief well injection spool;

connecting a first pipe to said first relief well injection spool so as to extend toward a surface location;

connecting a second pipe to said second relief well injection spool so as to extend toward another surface location;

flowing a kill fluid through said second pipe so that the kill fluid flows through the first flowline and into the flow channel of said first relief well injection spool so as to pass through said first relief well and into the well; and blocking the second relief well from communicating with the well.

2. The process of claim 1, the step of drilling the first relief well comprising:

drilling the first relief well in a direction toward the well;

stopping the drilling prior to intersecting the well; and plugging the first relief well.

3. The process of claim 2, said first pipe in a drill pipe, the process further comprising:

removing or penetrating the plug with said drill pipe; and drilling so as to intercept the well prior to the step of flowing the kill fluid.

4. The process of claim 1, the step of blocking the second relief well comprising:

drilling the second relief well so as to terminate the second relief well a distance away from the well.

5. The process of claim 1, the steps of drilling the first relief well and drilling the second relief well occurring during a same period of time.

6. The process of claim 1, the at least one flow channel of said first relief well injection spool comprising a first flow channel and a second flow channel, the at least one flow channel of said second relief well injection spool comprising a first channel and a second channel, the step of connecting the first flowline comprising:

connecting said first flowline to said first flow channel of said first relief well injection spool and to said first flow channel of said second relief well injection spool.

7. The process of claim 6, further comprising:

connecting a second flowline to said second flow channel of said second relief well injection spool and to said second flow channel of said first relief well injection spool.

8. The process of claim 1, the step of connecting said second pipe to said second relief well injection spool comprising:

extending a riser from said second relief well injection spool, said second pipe being a casing extending through an interior of said riser, said casing communicating with said main bore of said second relief well injection spool.

9. The process of claim 1, further comprising:

affixing a first blowout preventer on to said first relief well injection spool, said first pipe extending through said first blowout preventer; and extending choke-and-kill lines from the surface location to said first blowout preventer, said choke-and-kill lines communicating with an annulus of said first relief well.

10. The process of claim 9, said first pipe being a drill pipe, the step of flowing comprising:

flowing the kill fluid through an interior of said drill pipe into the well; and flowing the kill fluid through the choke-and-kill lines into the well.

11. The process of claim 8, the step of flowing comprising:

flowing the kill fluid through said casing and into said main bore of said second relief well injection spool;

flowing the kill fluid from said main bore of said second relief well injection spool to the at least one flow channel of said second relief well injection spool;

flowing the kill fluid from the at least one flow channel of said second relief well injection spool and through said first flowline;

flowing the kill fluid from said first flowline through said first relief well injection spool so as to pass into the first relief well; and flowing the kill fluid from the first relief well into the well.

12. The process of claim 11, further comprising:

stopping the flowing of the kill fluid when a weight of the kill fluid exceeds a bore pressure of the well.

13. A system for killing a well, the system comprising:

a first relief well having a wellhead;

a second relief well having a wellhead, said first relief being in spaced relation to said second relief well, each of said first and second relief wells extending in a direction toward the well, said first relief well communicating with the well, said second relief well being blocked from communication with the well;

a first relief well injection spool affixed to said wellhead of said first relief well, said first relief well injection spool having a main bore with at least one flow channel communicating therewith;

a second relief well injection spool affixed to said wellhead of said second relief well, said second relief well injection spool having a main bore with at least one flow channel communicating therewith;

a flowline connected to the flow channel of said first relief well injection spool and to the flow channel of said second relief well injection spool;

a first pipe received by said main bore of said first relief well injection spool, said first pipe extending to a surface location;

a second pipe communicating with said main bore of said second relief well injection spool, said second pipe extending to another surface location;

a first pumping system cooperative with said first pipe so as to pump the kill fluid through said first pipe and into said first relief well; and a second pumping system cooperative with said second pipe so as to pump the kill fluid through said second pipe, through the flow channel of said second relief well injection spool, through the flowline, through the first relief well injection spool and into said first relief well.

14. The system of claim 13, said first pipe being a drill pipe, said second pipe being a casing.

15. The system of claim 13, said at least one flow channel of said first relief well injection spool comprising a first flow channel and a second flow channel, said at least one flow channel of said second relief well injection spool comprising a first flow channel and a second flow channel, the flowline being connected to said first flow channel of said first relief well injection spool and to said first flow channel of said second relief well injection spool, the system further comprising:

another flowline connected to said second flow channel of said first relief well injection spool and to said second flow channel of said second relief well injection spool.

16. The system of claim 13, further comprising:

a first blowout preventer affixed to said first relief well injection spool, said first pipe extending through said first blowout preventer; and a second blowout preventer affixed to said second relief well injection spool, said second pipe extending through said second blowout preventer.

17. The system of claim 16, further comprising:

a choke-and-kill line connected to said first blowout preventer so as to pass the kill fluid from the surface location into an annulus of said first relief well.

18. The system of claim 17, said first pumping system pumping up to thirty barrels per minute of the kill fluid through said choke-and-kill line, said first pumping system pumping up to twenty barrels per minute of the kill fluid through said first pipe, said second pumping system pumping up to 180 barrels per minute of kill fluid into said second pipe.

19. The system of claim 13, said second pumping system comprising:

a first kill vessel connected to said second pipe; and a second kill vessel connected to said second pipe, said first and second kill vessels selectively or jointly pumping the kill fluid under pressure into said second pipe.

* * * * *